US010156326B2

(12) United States Patent
Mishan

(10) Patent No.: US 10,156,326 B2
(45) Date of Patent: Dec. 18, 2018

(54) FLASHLIGHT WITH MAGNETIC TAIL

(71) Applicant: E. Mishan & Sons, Inc., New York, NY (US)

(72) Inventor: Edward I. Mishan, New York, NY (US)

(73) Assignee: E. Mishan & Sons, Inc., New York, NY (US)

( * ) Notice: Subject to any disclaimer, the term of this patent is extended or adjusted under 35 U.S.C. 154(b) by 0 days.

(21) Appl. No.: 15/380,361

(22) Filed: Dec. 15, 2016

(65) Prior Publication Data

US 2018/0172223 A1 Jun. 21, 2018

(51) Int. Cl.

| | |
|---|---|
| ***F21L 4/04*** | (2006.01) |
| ***F21V 21/096*** | (2006.01) |
| ***F21V 23/04*** | (2006.01) |
| ***F21V 14/02*** | (2006.01) |

(52) U.S. Cl.

CPC ..... *F21L 4/045* (2013.01); *F21V 14/025* (2013.01); *F21V 21/0965* (2013.01); *F21V 23/0421* (2013.01)

(58) Field of Classification Search

CPC .... F21L 4/045; F21V 14/025; F21V 21/0965; F21V 23/0421

See application file for complete search history.

(56) References Cited

U.S. PATENT DOCUMENTS

| | | | | |
|---|---|---|---|---|
| 6,598,993 | B1 * | 7/2003 | Dalton | F21L 4/005 362/188 |
| 8,752,975 | B2 | 6/2014 | Rubino | |
| 9,140,417 | B2 | 9/2015 | Chen | |
| 2005/0201085 | A1 | 9/2005 | Aikawa | |
| 2015/0292691 | A1 * | 10/2015 | Li | F21L 4/085 362/158 |

FOREIGN PATENT DOCUMENTS

| | | | |
|---|---|---|---|
| CA | 2789155 | * | 8/2011 |
| CN | 87200053 U | | 3/1988 |

* cited by examiner

*Primary Examiner* — Tracie Y Green

(74) *Attorney, Agent, or Firm* — Notaro, Michalos & Zaccaria P.C.

(57) ABSTRACT

A flashlight with magnetic tail has a battery housing having a tail portion, a light source connected to a forward portion of the battery housing, a pushbutton assembly mounted in the tail portion and a magnet ring fixed to the tail portion and extending around the pushbutton assembly.

9 Claims, 1 Drawing Sheet

FLASHLIGHT WITH MAGNETIC TAIL

FIELD AND BACKGROUND OF THE INVENTION

The present invention relates generally to the field of flashlights, and in particular to a new and used flashlight with magnetic tail that allows the flashlight to be temporarily held to a ferro-magnetic surface or to be used to pick up small ferro-magnetic item.

SUMMARY OF THE INVENTION

It is an object of the present invention to provide a flashlight with magnetic tail comprising a battery housing having a tail portion; a light source connected to a forward portion of the battery housing; a pushbutton assembly mounted in the tail portion; and a magnet ring fixed to the tail portion and extending around the pushbutton assembly.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
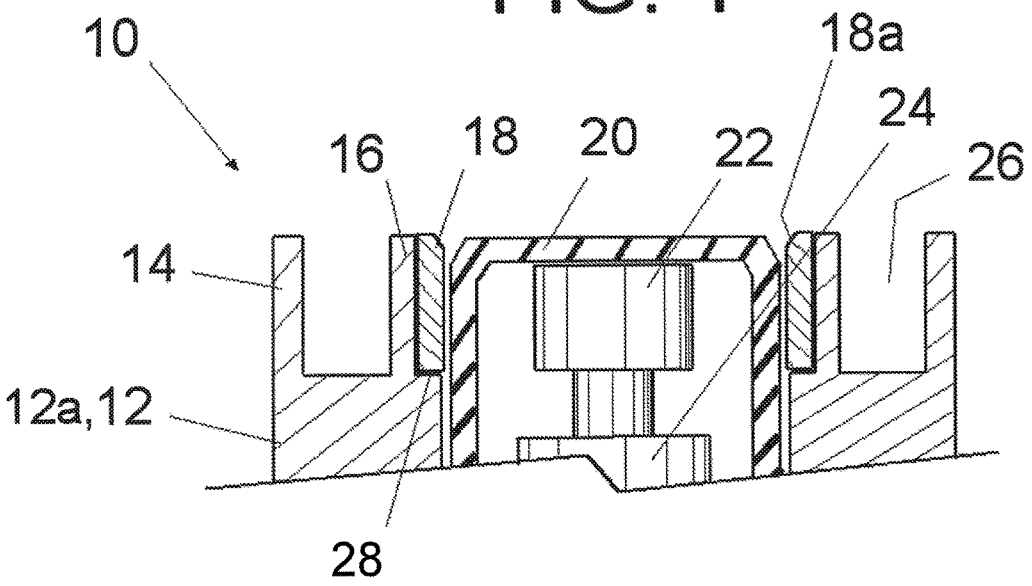
FIG. 1 is a partial, sectional view of a flashlight with magnetic tail according to the invention.

Referring now to the drawings, in which like reference numerals are used to refer to the same or similar elements, the invention is a flashlight 10 with magnetic tail that comprises a battery housing 12 for enclosing one or more batteries such as AA or AAA batteries or others of known type. The battery housing 12 has a tail portion 12*a* and a light source connected to an opposite, forward portion of the battery housing 12, as will be explained in connection with FIGS. 2 and 3.

An outer ring 14 extends axially outwardly from the tail portion 12*a* and an inner ring 16 is spaced radially inwardly of the outer ring and extends axially outwardly of the tail portion as well. The inner and outer rings are made of the same material and as one piece with the housing 12, e.g. aircraft aluminum, and they define an annular channel therebetween.

A permanent magnet ring 18 is fixed to the tail portion 12*a* and is positioned radially inwardly of the inner ring 16, the magnet ring 18 having an outer surface that is substantially coplanar with outer surfaces of the inner and outer rings 16 and 14. The outer axial end of ring 18 may, for example, be the North pole of the magnet, and the inner axial end maybe the South pole, although, the poles may be reversed or places radially. Any known magnetized material may be used to form the magnet ring 18, for example, the very strong Neodymium (rare earth) type magnetic material, or the more conventional magnetized ferro-magnet metals like iron, nickel or cobalt may be used.

A pushbutton assembly 20, 22, 24 is mounted in the tail portion 12*a* and positioned radially inwardly of the magnet ring 18, the pushbutton assembly having an outer surface that is substantially coplanar with the outer surfaces of the inner, outer and magnet rings 16, 14, 18.

The permanent magnet ring 18 has a radially inner bevel 18*a* at its outer surface, adjacent the pushbutton assembly and the tail portion 12*a* has a step 28 radially inwardly of the inner ring 16 on which the magnet ring 18 rests. Magnet ring 18, is fix, e.g. by strong adhesive, either to the inner surface of inner ring 16, or to the step 28, or to both.

Figure 2:
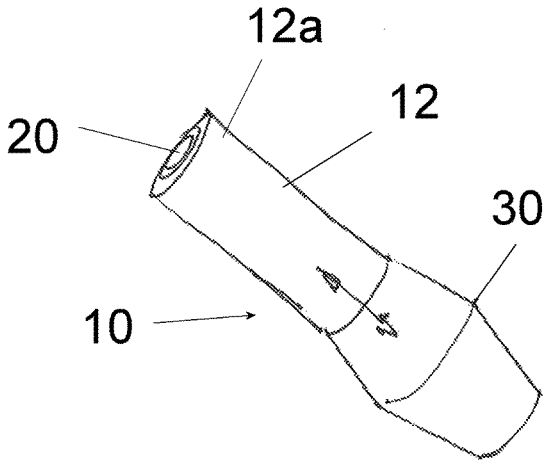
FIG. 2 is a rear perspective view of the flashlight of FIG. 1.
Figure 3:
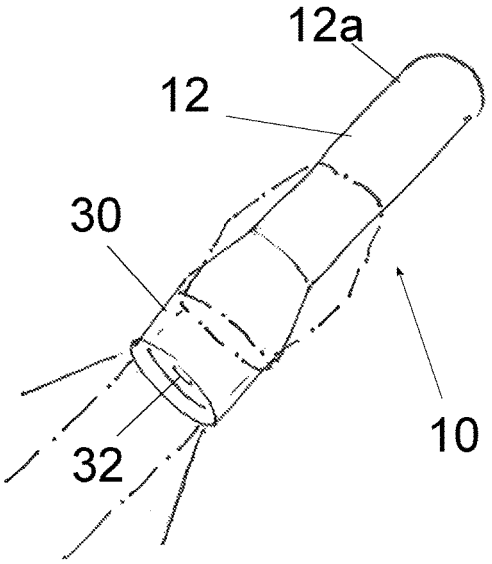
FIG. 3 is a front perspective view of the flashlight of FIG. 1.

With reference to FIGS. 2 and 3, the light source comprises a light source housing 30 mounted for sliding axial motion in the direction of the double arrow, to a forward portion of the battery housing 12, a light such as an LED or SMD (surface-mounted device) 32 in the light source housing 30 for casting a light beam that varies in spread angle as a function of a relative position between the battery housing 12 and the light source housing 30 as the light source housing 30 slides axially with respect to the battery housing 12. This is schematically illustrated by the solid and phantom line positions in FIG. 3.

While a specific embodiment of the invention has been shown and described in detail to illustrate the application of the principles of the invention, it will be understood that the invention may be embodied otherwise without departing from such principles.

What is claimed is:

1. A flashlight (10) with magnetic tail comprising:

a battery housing (12) having a tail portion (12*a*);

a light source connected to a forward portion of the battery housing (12);

an outer ring (14) extending axially outwardly from the tail portion (12*a*);

an inner ring (16) spaced radially inwardly of the outer ring and extending axially outwardly of the tail portion, the inner and outer rings defining an annular channel (26) therebetween;

a permanent magnet ring (18) fixed to the tail portion (12*a*), and positioned radially inwardly of the inner ring (16), the magnet ring (18) having an outer surface that is substantially coplanar with outer surfaces of the inner and outer rings (16, 14), the permanent magnetic ring (18) defining at least a portion of a bottom surface of the flashlight (10); and a pushbutton assembly (20, 22, 24) mounted in the tail portion and positioned radially inwardly of the magnet ring (18), the pushbutton assembly having an outer surface that is substantially coplanar with the outer surfaces of the inner, outer and magnet rings (16, 14, 18), wherein the light source comprises a light source housing (30) mounted for sliding axial motion to a forward portion of the battery housing (12), the light (32) in the light source housing (30) for casting a light beam that varies in spread angle as a function of a relative position between the battery housing (12) and the light source housing (30) as the light source housing (30) slides axially with respect to the battery housing (12).

2. The flashlight (10) with magnetic tail of claim 1, wherein the permanent magnet ring (18) has a radially inner bevel (18*a*) at its outer surface, adjacent the pushbutton assembly.

3. The flashlight (10) with magnetic tail of claim 1, wherein the tail portion (12*a*) has a step (28) radially inwardly of the inner ring (16) on which the magnet ring (18) rests.

4. The flashlight (10) with magnetic tail of claim 1, wherein the tail portion (12*a*) has a step (28) radially inwardly of the inner ring (16) on which the magnet ring (18) rests, the magnet ring (18) having a radially inner bevel (18*a*) at its outer surface, adjacent the pushbutton assembly and being fixed to at least one of a radially inner surface of the inner ring (16) and the step (28).

5. The flashlight (10) with magnetic tail of claim 1, wherein the pushbutton assembly comprises a rubber cover (20), a pushbutton (22) under the cover and a switch housing (24) to which the pushbutton is engaged.

6. The flashlight (10) with magnetic tail of claim 1, wherein the tail portion (12*a*) has a step (28) radially inwardly of the inner ring (16) on which the magnet ring (18) rests, the magnet ring (18) having a radially inner bevel (18*a*) at its outer surface, adjacent the pushbutton assembly and being fixed to at least one of a radially inner surface of the inner ring (16) and the step (28), the pushbutton assembly comprising a rubber cover (20), a pushbutton (22) under the cover and a switch housing (24) to which the pushbutton is engaged.

7. The flashlight (10) with magnetic tail of claim 1, wherein the light source comprises a light source housing (30) mounted for sliding axial motion to a forward portion of the battery housing (12), a light (32) in the light source housing (30) for casting a light beam that varies in spread angle as a function of a relative position between the battery housing (12) and the light source housing (30) as the light source housing (30) slides axially with respect to the battery housing (12), the magnet ring (18) having a radially inner bevel (18*a*) at its outer surface, adjacent the pushbutton assembly and being fixed to at least one of a radially inner surface of the inner ring (16) and the step (28).

8. The flashlight (10) with magnetic tail of claim 1, wherein the light source comprises a light source housing (30) mounted for sliding axial motion to a forward portion of the battery housing (12), a light (32) in the light source housing (30) for casting a light beam that varies in spread angle as a function of a relative position between the battery housing (12) and the light source housing (30) as the light source housing (30) slides axially with respect to the battery housing (12), the tail portion (12*a*) having a step (28) radially inwardly of the inner ring (16) on which the magnet ring (18) rests, the pushbutton assembly comprising a rubber cover (20), a pushbutton (22) under the cover and a switch housing (24) to which the pushbutton is engaged.

9. The flashlight (10) with magnetic tail of claim 1, including a light source housing (30) mounted for sliding axial motion to a forward portion of the battery housing (12), a light (32) in the light source housing (30) for casting a light beam that varies in spread angle as a function of a relative position between the battery housing (12) and the light source housing (30) as the light source housing (30) slides axially with respect to the battery housing (12), the tail portion (12*a*) having a step (28) radially inwardly of the inner ring (16) on which the magnet ring (18) rests, the magnet ring (18) having a radially inner bevel (18*a*) at its outer surface, adjacent the pushbutton assembly and being fixed to at least one of a radially inner surface of the inner ring (16) and the step (28), the pushbutton assembly comprising a rubber cover (20), a pushbutton (22) under the cover and a switch housing (24) to which the pushbutton is engaged.

* * * * *